US008550174B1

(12) United States Patent
Orgeron et al.

(10) Patent No.: US 8,550,174 B1
(45) Date of Patent: Oct. 8, 2013

(54) STABBING APPARATUS FOR CENTERING TUBULARS AND CASINGS FOR CONNECTION AT A WELLHEAD

(75) Inventors: Keith J. Orgeron, Tomball, TX (US); Axel Sigmar, Tomball, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 217 days.

(21) Appl. No.: 12/633,891

(22) Filed: Dec. 9, 2009

Related U.S. Application Data

(60) Provisional application No. 61/140,040, filed on Dec. 22, 2008.

(51) Int. Cl.
*E21B 19/16* (2006.01)

(52) U.S. Cl.
USPC ..... 166/380; 166/77.51; 166/85.5

(58) Field of Classification Search
USPC ..... 166/77.51, 85.5, 378–381
See application file for complete search history.

(56) References Cited

U.S. PATENT DOCUMENTS

| | | | | |
|---|---|---|---|---|
| 1,417,490 | A | 5/1922 | Brandon | |
| 2,147,002 | A * | 2/1939 | Volpin | 166/77.51 |
| 2,595,307 | A | 5/1952 | Selberg | |
| 3,016,992 | A | 1/1962 | Wilson | |
| 3,136,394 | A | 6/1964 | Woolslayer et al. | |
| 3,177,944 | A | 4/1965 | Knights | |
| 3,262,593 | A | 7/1966 | Hainer | |
| 3,280,920 | A | 10/1966 | Scott | |
| 3,365,762 | A | 1/1968 | Spiri | |
| 3,432,159 | A | 3/1969 | Rakatansky | |
| 3,464,507 | A | 9/1969 | Alexander et al. | |
| 3,561,811 | A | 2/1971 | Turner, Jr. | |
| 3,633,771 | A | 1/1972 | Woolslayer et al. | |
| 3,702,640 | A | 11/1972 | Cintract et al. | |
| 3,806,021 | A | 4/1974 | Moroz et al. | |
| 3,860,122 | A | 1/1975 | Cernosek | |
| 3,942,593 | A | 3/1976 | Reeve, Jr. et al. | |
| 3,986,619 | A | 10/1976 | Woolslayer et al. | |
| 4,135,340 | A | 1/1979 | Cox et al. | |
| 4,172,684 | A | 10/1979 | Jenkins | |

(Continued)

FOREIGN PATENT DOCUMENTS

GB 727780 A 4/1955

OTHER PUBLICATIONS

U.S. Appl. No. 11/923,451, filed Oct. 24, 2007; non-published; titled "Pipe Handling Apparatus and Method" and having common inventors with the present patent application.

(Continued)

*Primary Examiner* — Shane Bomar
*Assistant Examiner* — Catherine Loikith
(74) *Attorney, Agent, or Firm* — John G. Fischer, Esq.; Scheef & Stone, L.L.P.

(57) ABSTRACT

An apparatus for centering a first tubular with respect to a second tubular at a wellhead in which the apparatus has a frame, a gripping member extending outwardly of the frame and suitable for gripping the first tubular, and a guide member connected to the frame and extending outwardly therefrom. The guide member is positioned below the gripping member. The guide member has a slot therein suitable for receiving a portion of the second tubular therein. The slot of the guide member has a center vertically aligned with a center of the gripping member. The guide member is pivotally connected to the frame.

20 Claims, 6 Drawing Sheets

(56) References Cited

U.S. PATENT DOCUMENTS

| | | | | |
|---|---|---|---|---|
| 4,201,022 | A | 5/1980 | Jennings | |
| 4,221,269 | A | 9/1980 | Hudson | |
| 4,269,554 | A * | 5/1981 | Jackson | 414/22.63 |
| 4,290,495 | A | 9/1981 | Elliston | |
| 4,303,270 | A | 12/1981 | Adair | |
| 4,403,666 | A | 9/1983 | Willis | |
| 4,403,897 | A | 9/1983 | Willis | |
| 4,407,629 | A | 10/1983 | Willis | |
| 4,440,536 | A | 4/1984 | Scaggs | |
| 4,492,501 | A | 1/1985 | Haney | |
| 4,595,066 | A | 6/1986 | Nelmark et al. | |
| 4,605,077 | A * | 8/1986 | Boyadjieff | 175/85 |
| 4,650,237 | A | 3/1987 | Lessway | |
| 4,708,581 | A | 11/1987 | Adair | |
| 4,759,414 | A | 7/1988 | Willis | |
| 4,767,100 | A | 8/1988 | Philpot | |
| 4,822,230 | A | 4/1989 | Slettedal | |
| 4,834,604 | A | 5/1989 | Brittain et al. | |
| 4,837,992 | A | 6/1989 | Hashimoto | |
| 4,869,137 | A | 9/1989 | Slator | |
| 5,150,642 | A | 9/1992 | Moody et al. | |
| 5,186,264 | A | 2/1993 | du Chaffaut | |
| 5,458,454 | A | 10/1995 | Sorokan | |
| 5,609,226 | A | 3/1997 | Penisson | |
| 5,609,457 | A * | 3/1997 | Burns | 414/22.51 |
| 5,660,087 | A | 8/1997 | Rae | |
| 5,702,139 | A | 12/1997 | Buck | |
| 5,806,589 | A | 9/1998 | Lang | |
| 5,809,589 | A | 9/1998 | Lang | |
| 5,848,647 | A | 12/1998 | Webre et al. | |
| 5,988,299 | A | 11/1999 | Hansen et al. | |
| 5,992,801 | A | 11/1999 | Torres | |
| 5,993,140 | A | 11/1999 | Crippa | |
| 6,220,807 | B1 | 4/2001 | Sorokan | |
| 6,237,445 | B1 | 5/2001 | Wesch, Jr. | |
| 6,263,763 | B1 | 7/2001 | Feigel, Jr. et al. | |
| 6,298,928 | B1 | 10/2001 | Penchansky | |
| 6,533,045 | B1 | 3/2003 | Cooper | |
| 6,543,551 | B1 | 4/2003 | Sparks et al. | |
| 6,543,555 | B2 | 4/2003 | Casagrande | |
| 6,550,128 | B1 * | 4/2003 | Lorenz | 29/464 |
| 6,609,573 | B1 | 8/2003 | Day | |
| 6,705,414 | B2 | 3/2004 | Simpson et al. | |
| 6,745,646 | B1 | 6/2004 | Pietras et al. | |
| 6,748,823 | B2 | 6/2004 | Pietras | |
| 6,779,614 | B2 | 8/2004 | Oser | |
| 6,814,149 | B2 | 11/2004 | Liess et al. | |
| 6,845,814 | B2 | 1/2005 | Mason et al. | |
| 7,017,450 | B2 | 3/2006 | Bangert | |
| 7,028,585 | B2 | 4/2006 | Pietras et al. | |
| 7,036,202 | B2 * | 5/2006 | Lorenz | 29/464 |
| 7,055,594 | B1 | 6/2006 | Springett et al. | |
| 7,090,035 | B2 | 8/2006 | Lesko | |
| 7,090,254 | B1 | 8/2006 | Pietras et al. | |
| 7,117,938 | B2 | 10/2006 | Hamilton et al. | |
| 7,121,166 | B2 | 10/2006 | Drzewiecki | |
| 7,438,127 | B2 | 10/2008 | Lesko | |
| 7,503,394 | B2 | 3/2009 | Bouligny | |
| 8,235,104 | B1 | 8/2012 | Sigmar et al. | |
| 2003/0221871 | A1 | 12/2003 | Hamilton et al. | |
| 2006/0278400 | A1 * | 12/2006 | Bouligny | 166/379 |
| 2007/0074460 | A1 | 4/2007 | Belik | |
| 2008/0174131 | A1 | 7/2008 | Bouligny et al. | |
| 2009/0071720 | A1 | 3/2009 | Cowan | |
| 2010/0187740 | A1 | 7/2010 | Orgeron | |

OTHER PUBLICATIONS

U.S. Appl. No. 12/111,907, filed Apr. 29, 2008; non-published; titled "Pipe Gripping Apparatus" and having common inventors with the present patent application.

* cited by examiner

STABBING APPARATUS FOR CENTERING TUBULARS AND CASINGS FOR CONNECTION AT A WELLHEAD

RELATED U.S. APPLICATIONS

The present application claims priority from U.S. Provisional Patent Application No. 61/140,040, filed by the present applicant on Dec. 22, 2008.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to apparatus for delivery of tubulars to and from a wellhead. Particularly, the present invention relates to an apparatus for aligning two tubulars over a wellhead. More particularly, the present invention relates to stabbing guides for tubulars.

2. Description of Related Art Including Information Disclosed Under 37 CFR 1.97 and 37 CFR 1.98.

Drill rigs utilize several methods for transferring tubular members from a pipe rack adjacent to the drill floor to a mousehole in the drill floor or the well bore for connection to a previously transferred tubular or tubular string. The term "tubular" as used herein includes all forms of pipe, drill pipe, drill collars, casing, liner, bottom hole assemblies (BHA), and other types of tubulars known in the art.

Conventionally, drill rigs utilize a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table at the well head. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

One method of transferring pipe from the rack to the well platform comprises tying one end of a line on the rig around a selected pipe on the pipe rack. The pipe is thereafter lifted up onto the platform and the lower end thereof is placed into the mousehole. The mousehole is simply an upright, elongate cylindrical container adjacent to the rotary table which supports the pipe temporarily. When it is necessary to add the pipe to the drill string, slips are secured about the drill string on the rotary table thereby supporting the same in the wellbore. The pipe is disconnected from the traveling equipment, and the elevators, or the kelly, are connected to the pipe in the mousehole. Next, the traveling block is raised by positioning the pipe over the drill string. Tongs are used to secure the pipe to the upper end of the drill string. The drill pipe elevators suspend the drill pipe from a collar, which is formed around one end of the pipe and does not clamp the pipe, thereby permitting rotational pipe movement in order to threadably engage the same to the drill string.

A prior art technique for moving joints of casing from racks adjacent to the drilling rig comprises tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Because the rope is tied around the casing at one end thereof, the casing does not hang vertically, but rather tilts somewhat. A man working on a platform elevated above the rig floor must hold the top of the casing and straighten it out while the casing is threaded into the casing string, which is suspended in the well bore by slips positioned on the rotary table.

It is desirable to be able to grip casing or pipe positioned on a rack adjacent a drilling well, move the same into vertical orientation over the well bore, and thereafter lower the same onto the string suspended in the well bore.

In the past, various devices have been created which mechanically move a pipe from a horizontal orientation to a vertical orientation such that the vertically-oriented pipe can be installed into the wellbore. Typically, these devices have utilized several interconnected arms that are associated with a boom. In order to move the pipe, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programing is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary to as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

In the past, pipe handling apparatus have not been used for the installation of casing. The problem associated with casing is that the threads of the casing are formed on an inner wall and on an outer wall at the ends of each of the casing sections. Whenever these threads are formed, the relatively thin wall thickness of the casing is further minimized. Additionally, great precision is required so as to properly thread the threads of one casing section within the threads of an adjacent casing section. The amount of accuracy required for the delivery of the casing by a pipe handling apparatus, in the past, has not been sufficient so as to achieve the desired degree of accuracy for the installation of the casing sections in their threaded connection. The improper installation of one casing section upon another casing section can potentially damage the threads associated with such casing sections. Additionally, in the past, the pipe handling apparatus could potentially damage the thin-walled casing sections during the delivery. As such, a need has developed to adapt a pipe handling apparatus so as to achieve the desired amount of accuracy for the installation of casing sections.

Various patents have issued relating to tubular handling apparatus. For example, U.S. application Ser. No. 11/923,451, filed on Oct. 24, 2007, discloses a pipe handling apparatus that has a boom pivotally movable between a first position and a second position, a riser assembly pivotally connected to the boom, an arm pivotally connected at one end to the first portion of the riser assembly and extending outwardly therefrom, a gripper affixed to an opposite end of the arm suitable for gripping a diameter of the pipe, a link pivotally connected to the riser assembly and pivotable so as to move relative to the movement of the boom between the first and second positions, and a brace having one end pivotally connected to the boom and an opposite end pivotally connected to the arm between the ends of the arm. The riser assembly has a first portion extending outwardly at an obtuse angle with respect to the second portion. The gripper has a stab frame affixed to an end of the arm, and grippers affixed to the side of the stab frame opposite the arm.

U.S. Pat. No. 3,177,944, issued on Apr. 13, 1965 to R. N. Knights, describes a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969 to E. L. Alexander et al., teaches a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a drawwork. A power drill drive is carried by the traveling block. An elevator for drill pipe is carried by an arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771, issued on Jan. 11, 1972 to Woolslayer et al., discloses an apparatus for moving drill pipe into and out of an oil well derrick. A stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975 to L. C. Cernosek, describes an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A load means is operably attached or associated with the platform and positioning means in order to move the pipe in a stored position to a transfer position in which the pipe is transferred to the positioner. The positioner includes a tower having pivotally mounted thereon a pipe track with a plurality of pipe clamp assemblies which are adapted to receive a pipe length. The pipe track is pivotally movable by hydraulic power means or gear means between a transfer position in which pipe is moved into the plurality of clamp assemblies and the release position in which the pipe is released for movement to a submerged position.

U.S. Pat. No. 3,986,619, issued on Oct. 19, 1976 to Woolslayer et al., shows a pipe handling apparatus for an oil well drilling derrick. In this apparatus the inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684, issued on Oct. 30, 1979 to C. Jenkins, shows a floor level pipe handling apparatus which is mounted on the floor of an oil well derrick suitable structure. This apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666, issued on Sep. 13, 1983 to C. A. Willis, shows self-centering tongs and a transfer arm for a drilling apparatus. The clamps of the transfer arm are resiliently mounted to the transfer arm so as to provide limited axial movement of the clamps and thereby of a clamped down hole tubular. A pair of automatic, self-centering, hydraulic tongs are provided for making up and breaking out threaded connections of tubulars.

U.S. Pat. No. 4,407,629, issued on Oct. 4, 1983 to C. A. Willis, teaches a lifting apparatus for downhole tubulars. This lifting apparatus includes two rotatably mounted clamps which are rotatable between a side-loading position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a downhole tubular positioned in the clamp. In this position, the clamped tubular is aligned with a safety plate mounted on the boom to prevent a clamped tubular from slipping from the clamps.

U.S. Pat. No. 4,492,501, issued on Jan. 8, 1985 to Haney, discloses a platform positioning system for a drilling operation which includes a support structure and a transfer arm pivotally connected to the support structure to rotate about a first axis. This platform positioning system includes a platform which is pivotally connected to the support structure to rotate about a second axis, and rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066, issued on Jun. 17, 1986 to Nelmark et al., provides an apparatus for handling drill pipes and used in association with blast holes. This system allows a drill pipe to be more easily connected and disconnected to a drill string in a hole being drilled at an angle. A receptacle is formed at the lower end of the carrier that has hydraulically operated doors secured by a hydraulically operated lock. A gate near the upper end is pneumatically operated in response to the hydraulic operation of the receptacle lock.

U.S. Pat. No. 4,822,230, issued on Apr. 18, 1989 to P. Slettedal, teaches a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604, issued on May 30, 1989 to Brittain et al., provides a pipe moving apparatus and method for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the well bore and the additional pipe or casing joint is threaded thereto.

U.S. Pat. No. 4,708,581, issued on Nov. 24, 1987 H. L. Adair, provides a method for positioning a transfer arm for the movement of drill pipe. A drilling mast and a transfer arm are mounted at a first axis adjacent the mast to move between a lowered position near ground level and an upper position aligned with the mast. A reaction point anchor is fixed with respect to the drilling mast and spaced from the first axis. A fixed length link is pivotally mounted to the transfer arm at a second axis, spaced from the first axis, and a first single stage cylinder is pivotally mounted at one end to the distal end of the link and at the other end to the transfer arm. A second single stage hydraulic cylinder is pivotally mounted at one end to the distal end of the link and at the other end to the reaction point.

U.S. Pat. No. 4,759,414, issued on Jul. 26, 1988 to C. A. Willis, provides a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn, support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454, issued on Oct. 17, 1995 to R. S. Sorokan, describes a pipe handling method which is used to move tubulars used from a horizontal position on a pipe rack adjacent the well bore to a vertical position over the wall center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes apparatus for carrying out the method of U.S. Pat. No. 5,458,454.

U.S. Pat. No. 6,609,573, issued on Aug. 26, 2003 to H. W. F. Day, teaches a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414, issued on Mar. 16, 2004 to Simpson et al., describes a tubular transfer system for moving pipe between a substantially horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614, issued on Aug. 24, 2004 to M. S. Oser, shows another system and method for transferring pipe. A pipe shuttle is used for moving a pipe joint into a first position and then lifting upwardly toward an upper second position.

In well-drilling and well-completion operations, it is necessary to lift and properly align lengths of downhole tubulars. For example, in oil or water well drilling, multiple lengths of drill pipe must often be raised from a horizontal position at or near ground level to a vertical position aligned with the centerline of the well. Such lifting and aligning operations require clamps for securely holding the pipe in place as it is lifted. When a pivotally mounted pipe boom is used, this boom must support large loads in several different orientations.

Compounding this problem is the fact that each joint of a length of a downhole tubular must be closely aligned with a string of such tubulars after it has been lifted to the vertical position, such as when a drill pipe or casing is made up. A clamp, or gripper, for this purpose should preferably provide a necessary alignment for downhole tubulars having various diameters, without any adjustment. Proper alignment has been a problem with many such clamps, or grippers, of the prior art, especially those employing pivoted clamping jaws. When pivoted clamping jaws are used, there is a tendency for the center of the downhole tubular to vary as a function of the diameter of the tubular being clamped.

Various patents and patent applications relate to grippers of tubular handling apparatus. For example, U.S. patent application Ser. No. 12/111,907, filed on Apr. 29, 2008 by the present inventor, discloses a pipe gripping apparatus having a first jaw with a pipe-contacting surface at one end thereof, a second jaw having a pipe-contacting surface at one end thereof, a tongue having a pipe-contacting surface at one end thereof, and an actuator connected to the first and second jaws and to the tongue. The actuator serves to move the first and second jaws and the tongue such that the pipe-contacting surfaces thereof move radially inwardly simultaneously for a substantially identical distance. A first link pivotally connects the tongue with the first jaw. A second link pivotally connects the tongue with the second jaw. The first and second links extend angularly outwardly from the tongue. The first and second pivot points of each jaw have a distance unequal to a distance between the first pivot point and pipe-contacting surface of each jaw. The pipe-contacting surfaces can be elastomeric pads, toothed dies, or rollers.

U.S. Pat. No. 3,280,920 issued on Oct. 25, 1966 to P. Scott, teaches a portable apparatus for drilling downhole wells. This apparatus has a mast having an open side and a means for supporting a string of drill pipes rotated within the mast. A means for raising and lowering a string of drill pipes in a rectilinear direction parallel to the longitudinal centerline of the mast is provided. This apparatus includes a hydraulic cylinder connected through a suitable arrangement of lines and sheaves so as to apply positive force upon the power swivel so as to move the swivel upwardly or downwardly in the mast as desired. This swivel is mounted on a wheeled carriage which runs on suitable tracks carried by the mast. An elongate frame is pivotably attached to the lower end of the mast for swinging movement to an open side of the mast between a substantially horizontal position and an upright position. Releasable clamps are adapted to grip a section of drill pipe mounted on the frame for a limited longitudinal reciprocating motion thereon.

U.S. Pat. No. 3,365,762, issued on Jan. 30, 1968 to W. H. Spiri, shows a well pipe gripping structure having a slip body having a pipe gripping insert which is slidably movable horizontally into an arcuate guideway in the slip body. The slip body is retained within the guideway by upper and lower lips on the body. The lips have asymmetric retaining surfaces. The inserts are provided with teeth which advance vertically as the teeth advance circularly. The teeth of one insert are positioned out of alignment with the teeth of the other insert to increase the resistance to rotation of the pipe within the slip structure.

U.S. Pat. No. 3,561,811, issued on Feb. 9, 1971 to J. W. Turner, Jr., teaches a well drilling rig having a pipe racker apparatus in which a number of racker arms are controllable from a remote location to engage drill pipe tool joints and drill collars. One of the arms has a head for supporting the weight of lengths of pipe or drill collars being added to or removed from the drill string.

U.S. Pat. No. 3,702,640, issued on Nov. 14, 1972 to Cintract et al., shows a tipping girder with a transfer of tubular elements. This tipping girder has a plurality of adjustable guide nippers movably positioned on the girder for movement transverse to the longitudinal axis thereof. There are adjustable locking nippers movably mounted on the girder for movement parallel to and transverse to the longitudinal axis thereof. The locking nippers are constructed to automatically engage and lock a rod on the girder when it is moved away from the horizontal position.

U.S. Pat. No. 3,806,021, issued on Apr. 23, 1974 to Moroz et al., shows a pipe centering apparatus. This apparatus has a carriage with a column mounted thereon to support a pipe end jointing mechanism. The carriage has a receptacle together with the column. The column pivotally supports a cantilever member of which the free extremity pivotably supports the pipe end jointing mechanism including coaxially arranged grippers adapted to retain the ends of the pipe.

U.S. Pat. No. 4,303,270, issued on Dec. 1, 1981 to H. L. Adair, shows a self-centering clamp for downhole tubulars. This clamp includes first and second opposed clamping members guided along a clamping axis by first and second guide channels defined by a frame. Each clamping member defines a hydraulic cylinder in which is disposed a piston which is rigidly mounted to the frame. A rack is coupled to move with each of the clamping members. These racks are interconnected via a pinion gear which meshes with both racks so that the two clamping members move in a counter-directional manner and remain equidistant from a central point on the clamping axis.

U.S. Pat. No. 4,403,897, issued on Sep. 13, 1983 to C. A. Willis, provides a self-centering clamp for drilling tubulars. This self-centering clamp includes first and second transverse guide rods. Two opposed clamping jaws are guided along the first guide rod. These jaws are positioned by two opposed rocker arms, each of which is mounted to a cross brace which slides along the second guide rod. The rocker arms are symmetrically positioned by a link mechanism which also slides along the second guide rod and by a hydraulic cylinder coupled between the two rocker arms. The frame is pivotably mounted to a pipe boom so as to rotate about an axis parallel to the clamped pipe and transverse to the first and second guide rods.

U.S. Pat. No. 4,650,237 issued on Mar. 17, 1987 to R. J. Lessway, provides an automatic centering and gripping apparatus which includes a housing in which is slidably mounted a longitudinal movable operator body. A pair of gripper arms is slidably mounted on the operator body. Each gripper arm carries a gripper member engageable with a workpiece. The gripper members are moved longitudinally and laterally into gripping engagement with a workpiece when the operator body is moved in one longitudinal direction. They are correspondingly disengaged from the workpiece when the operator body is moved in the other longitudinal direction.

U.S. Pat. No. 5,609,226 issued on Mar. 11, 1997 to D. J. Penisson, teaches a slip-type gripping assembly having an outer body defining a longitudinal through opening for receipt of the object. A number of slip bodies are circumferentially spaced about the through opening and are radially movable toward and away from the locus of the object. Each slip body is pivotable about a generally longitudinal axis and generally circumferentially centered with respect to the slip body as well as about a tangential axis. A respective force transfer formation is cooperative between each slip body and the outer body for transferring radial force therebetween while permitting the pivoting.

U.S. Pat. No. 5,848,647, issued on Dec. 15, 1998 to Webre et al., shows a pipe gripping apparatus for angularly adapting two misaligned pipes on one or more pipe strings. The apparatus has a housing having internal, opposing downwardly-curved surfaces therein and forming a longitudinal opening for passing a portion of at least one tubing string therethrough. A plurality of slip carriers each has an exterior surface contoured to match the downwardly curved surface and has a downwardly inclined interior surface. Each slip carrier is in movable connection with one of the curved surfaces of the housing. A plurality of slips has downwardly inclined exterior surfaces and longitudinal channels formed on an internal surface for holding gripping elements for gripping a portion of the pipe.

U.S. Pat. No. 5,992,801, issued on Nov. 30, 1999 to C. A. Torres, discloses a pipe gripping assembly and method. The pipe gripping assembly has a primary pipe gripping mechanism and a backup and a secondary pipe gripping mechanism carried in a single tapered slip bowl. The primary gripping mechanism employs smooth surface pipe dies that set against and grip and hold the pipe without damaging the pipe surface. After the primary mechanism is set, toothed dies in the secondary gripping mechanism are automatically engaged with the pipe with only a minimal pipe gripping force. Additional slippage of the pipe through the smooth dies sets the toothed dies down against a wedging surface to grip and hold the pipe to stop its downward movement. A resilient biasing device is used to urge the toothed dies away from the pipe before the smooth dies are set.

U.S. Pat. No. 5,993,140, issued on Nov. 30, 1999 to A. Crippa, shows an apparatus for loading pipes onto processing machines. This apparatus has a handler arm with a first segment and a second segment disposed in succession. Kinematic members are adapted to determine a fixed ratio between the rotation angles of the segments about the respective hinging axes.

U.S. Pat. No. 6,543,551, issued Apr. 8, 2003 to Sparks et al., discloses an automatic pipe handling device which includes a support frame mounted on a boring device. Removable pipe racks can be placed in position on the support frame to deliver pipe to the spindle axis or to remove pipe therefrom as required. The pipe sections are removed from the pipe rack and positioned on the spindle axis by pipe grippers mounted on hydraulic cylinders mounted on a rotating longitudinal shaft. The grippers and shaft simultaneously return the used pipe sections for storage to the pipe rack.

U.S. Pat. No. 6,543,555, issued on Apr. 8, 2003 to M. Casagrande, provides an automatic loader for drill rods adapted to be used in association with a boring machine. The automatic motor has a store containing a plurality of drill rods and a movement assembly that is able to selectively remove, one at a time, the drill rods from the store to position them on the guide and drive assembly. The movement assembly is arranged in an intermediate position between the store and the guide and drive assembly so as to not interfere with the latter during the removal of the drill rods from the store.

U.S. Pat. No. 6,845,814, issued on Jan. 25, 2005 to Mason et al., teaches a pipe-gripping structure having load rings. In particular, a rotary slip supports a drill string having a plurality of slip segments connected to define an opening for insertion of the drill string. Each slip segment has a head region, a toe region, and an inner radial surface axially extending between the head and toe regions. The inner radial surface of each slip segment comprises a circumferential groove. A plurality of axially aligned drill string gripping inserts are attached to each slip segment between the head region and the circumferential groove. Each insert has a gripping surface for contacting the drill string.

U.S. Pat. No. 7,055,594, issued on Jun. 6, 2006 to Springett et al., describes a pipe gripper and top drive system in which the pipe gripping system is located beneath the top drive unit. The pipe gripping system has an open throat for receiving a tubular to be gripped by the pipe gripping system. The gripping system has a body with first and second jaws movably connected thereto and a piston/cylinder assembly movably interconnected with each jaw for moving the jaws to clamp and then to rotate the pipe.

U.S. Pat. No. 7,090,035, issued on Aug. 15, 2006 to G. Lesko, describes a method and system for connecting pipe to a top drive motor. This system includes a top drive motor that tilts about a horizontal axis and a pipe launcher that brings joints of pipe up to the drilling platform for connection with a top drive motor at a safe and convenient height above the platform. The top drive motor further includes a clamping assembly that grasps and pulls the joint of the pipe to the motor as the connection is being made. The clamp assembly supports the motor-pipe connection as the top drive motor is raised in the drilling mast of the rig bringing the joint of pipe up into a vertical orientation for connection with the drill tubing string.

U.S. Pat. No. 7,121,166, issued on Oct. 17, 2006 to Drzewiecki, discloses a tong assembly that has a body and a center member slidable relative to the body. A pair of clamping arms are rotatably connected to the body. The clamping arms are connected to the center member such that as the center member slides relative to said body, the clamping arms rotate relative to the body. The assembly also comprises a plurality of die assemblies, wherein at least one die assembly is mounted to each clamping arm and at least one die assembly is mounted to the center member.

A problem associated with tubular handling apparatus is that the tubulars delivered to and from a wellhead can be long and very large, and thus very heavy. Thus, it is difficult to align one tubular over another. Two tubulars are typically joined together at a wellhead with threaded connections. The lower tubular has a threaded socket, or box. The upper tubular has a slightly-tapered threaded pin. While connecting the pin of the upper tubular with the box of the lower tubular, it is very easy to incorrectly insert the pin into the socket, which results in the stripping of the threads of the pin and socket of the two tubulars. The stripping of the threads can damage the tubulars and make them useless. Not only must the upper tubular be discarded, the lower tubular must be pulled out of the ground and disconnected from the drill string. Thus, there is a need for a way to correctly align two tubulars at a wellhead so as to correctly connect the pin and box.

Another problem associated with tubular handling apparatus is that the alignment of tubulars over a wellhead is commonly performed by a person, commonly called a "stabber." Due to the large size and weight of the tubulars, the job of aligning tubulars at a wellhead is very dangerous. Thus, there is a need for a tubular aligning apparatus that reduces the risk of injury during alignment.

Various patents have issued relating to apparatus for tubular alignment. For example, U.S. Pat. No. 7,090,254, issued on Aug. 15, 2006 to Pietras et al., discloses an apparatus for aligning a first tubular and a second tubular. The apparatus has a guide, a tong, and a back-up unit. The back-up unit has jaws that are movable towards and away from the first tubular. The tong has jaws that are movable toward and away from the second tubular. The guide is arranged on the tong or the back-up unit. The guide is movable toward and away from the first or second tubular with respect to the back-up unit. The back-up unit and the tong are movable into gripping engagement with the first and second tubulars. The tong is capable of applying a torque to rotate the second tubular relative to the first tubular.

U.S. Pat. No. 6,748,823, issued on Jun. 15, 2004 to Pietras, discloses an apparatus for aligning a first tubular and a second tubular. The first tubular extends through a power tong, and the second tubular extends through a back-up tong. The apparatus has a positioning guide for guiding the power tong with respect to the back-up tong. The positioning guide maintains the power tong and the backup tong in a certain juxtaposition during a tubular stabbing operation. The apparatus has spaced-apart locating rods projecting from one of either the power tong and the back-up tong. Spaced-apart blocks are positioned on the other side of the power tong back-up tong. Each block has a recess shaped to receive an end of one of the spaced-apart locating rods.

U.S. Pat. No. 6,745,646, issued on Jun. 8, 2004 to Pietras et al., discloses an apparatus for facilitating the connection of pipes that has a rotary and a stator. The rotary has a hydraulically actuated jaw, and a pump for pumping hydraulic fluid for actuation of the jaw. The stator has a motor arranged on the stator. Rotational energy can be transferred from the motor to the pump in an operational configuration. The motor has a motor-driver. The pump has a pump-driver. The motor-driver and the pump-driver are mechanically engageable.

U.S. Pat. No. 6,814,149, issued on Nov. 9, 2004 to Liess et al., discloses an apparatus and method for positioning a tubular relative to a tong. A positioning tool is mounted on a lower portion of the tong. The positioning tool includes a positioning member for determining a position of the tubular and a centering member for engaging the tubular. The positioning tool also has an actuation device that actuates the centering member. The position of the tubular can be actively adjusted by actuating the centering member.

It is an object of the present invention to provide correct alignment of tubulars over a well head.

It is another object of the present invention to align the threaded connections of two tubulars at a wellhead.

It is another object of the present invention to align tubulars at a wellhead without the use of a derrick.

It is still another object of the present invention to provide an apparatus that can grip different diameters of tubulars.

It is another further object of the present invention to provide an apparatus that uses a gripper to align a tubular over a tubular string.

These and other objects and advantages of the present invention will become apparent from a reading of the attached specification and appended claims.

BRIEF SUMMARY OF THE INVENTION

The present invention is an apparatus for centering a first tubular with respect to a second tubular at a wellhead. As used herein, the term "tubular" can refer to pipes, drill strings, casings, and other round diameter members that are installed at a well. The apparatus includes a frame, a gripping member extending outwardly of the frame and suitable for gripping the first tubular, and a guide member connected to the frame and extending outwardly therefrom. The guide member is positioned below the gripping member. The guide member has a slot therein suitable for receiving a portion of the second tubular therein. The slot of the guide member has a center that is vertically aligned with a center of the gripping member.

In the preferred embodiment of the present invention, the guide member is pivotally connected to the frame. The guide member is movable between a stowed position and a deployed position. The center of the slot of the guide member is vertically aligned with the center of the gripping member when the guide member is in the deployed position. The guide member has a guide body with the slot formed therein and an arm affixed at one end to the guide body and pivotally connected to the frame at an opposite end thereof. The frame has a front surface and a back surface. The arm is juxtaposed against the back surface when the guide member is in the stowed position.

The gripping member extends horizontally outwardly from the frame. The guide member extends horizontally directly below the gripping member. The gripping member, in the preferred embodiment, can include a first gripper and a second gripper extending in parallel spaced relation to the first gripper. The gripping member includes a jaw assembly having a tubular-contacting surface, a drive yoke having a tubular-contacting surface at an end thereof, and an actuator connected to the drive yoke. The drive yoke is connected to the jaw assembly. The actuator is suitable for moving the jaw assembly and the drive yoke such that the tubular-contacting surfaces thereof move radially for a substantially identical distance. The jaw assembly, in particular, includes a first jaw connected to the drive yoke, and a second jaw connected to the drive yoke. The gripping member further includes a first link connected to the first jaw and to the drive yoke, and a second link connected to the second jaw and to the drive yoke. The first link is pivotally connected to the first jaw at a first pivot point. The first link is pivotally connected to the drive yoke at a second pivot point. The second link being pivotally connected to the first jaw at a first pivot point. The second link is also pivotally connected to the drive yoke at a second pivot point.

The slot of the guide member has a first side and a second side spaced from each other by a distance approximately equal to a diameter of the second tubular. The slot of the guide member has an inner surface extending between the first side and the second side. This inner surface has a radius approximately equal to a radius of a portion of the second tubular.

The present invention also includes a structural member and an arm interconnected to the structural member and extending outwardly therefrom. The frame is connected to an end of the arm. The structural member is movable between a generally horizontal orientation and an upwardly extending orientation. The arm extends outwardly of the structural member when the structural member is in the upwardly extends position such that the gripping member extends in a horizontal orientation.

DETAILED DESCRIPTION OF THE INVENTION

Figure 1:
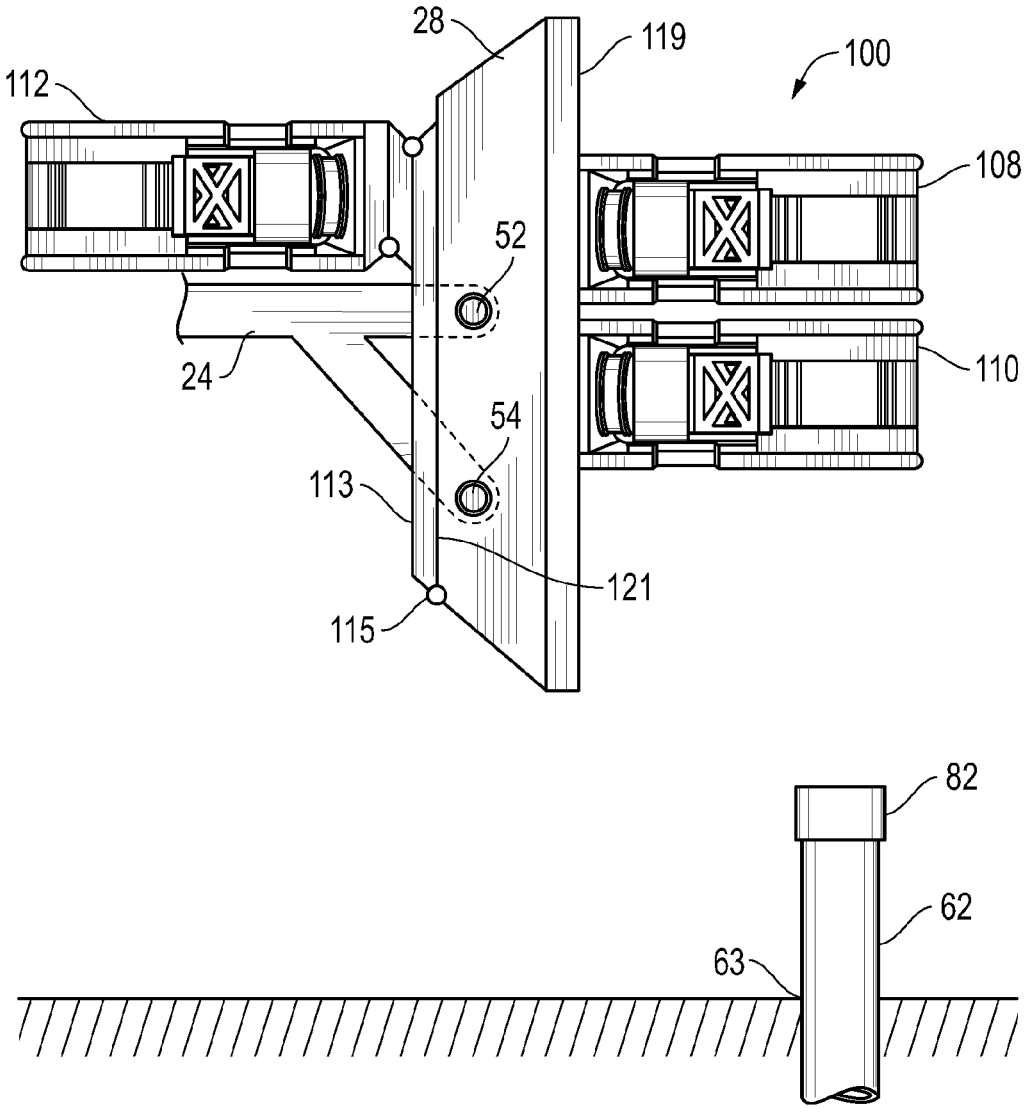
FIG. 1 shows a side elevational view of the preferred embodiment of the apparatus of the present invention, with the guide member in the stowed position.

Referring to FIG. 1, there is shown a side elevational view of the preferred embodiment of the apparatus 100. The apparatus 100 has a stab frame 28. The stab frame 28 supports grippers thereon. The stab frame 28 can be connected to an arm 24 of a tubular handling system by pins 52 and 54. A first gripper 108 is connected to a side 119 of the stab frame 28. A guide member 112 is connected to an opposite side 121 of the stab frame 28. A second gripper 110 is connected to a side 119 of the stab frame 28 below the first gripper 108. A pivoting means 113 connects the guide member 112 to the stab frame 28 at pivot point 115. The pivoting means 113 can be any appropriate mechanism for pivoting the guide member 112 from a stowed position to a deployed position. The guide member 112 is shown in the stowed position in FIG. 1. First gripper 108 and second gripper 110 are shown as having centers vertically aligned above the box 82 of tubular 62 of a wellhead 63. The pivoting means 113 can have various sections that pivot with respect to one another. These sections are shown as folded upon one another in FIG. 1.

Figure 2:
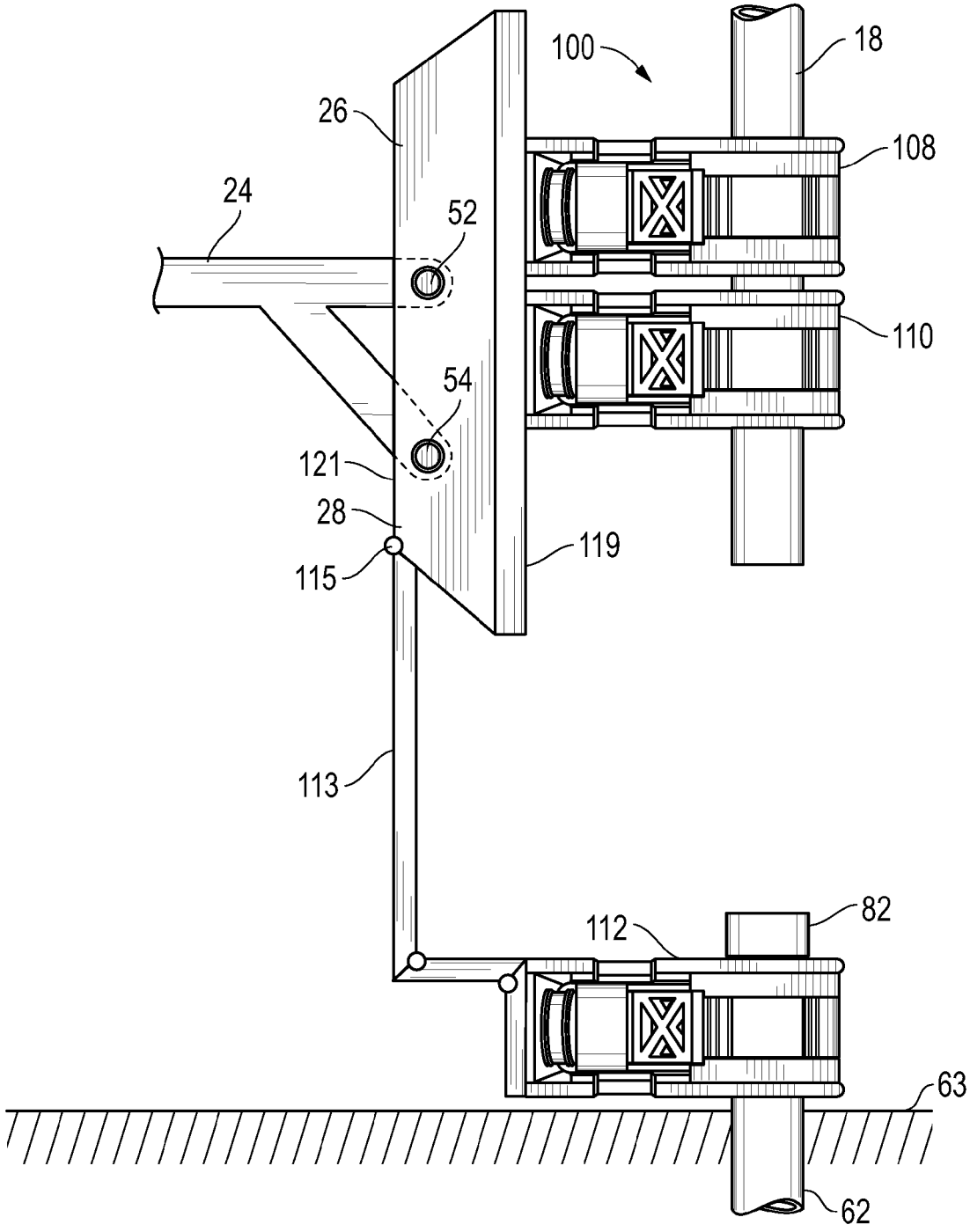
FIG. 2 shows a side elevational view of the apparatus of the present invention, with the guide member in a deployed position.

Referring to FIG. 2, there is shown a side elevational view of the apparatus 100 of the present invention, with the guide member 112 in a deployed position. The guide member 112 has sides that extend around tubular 62 below the box 82. The box 82 is a threaded connection by which tubular 62 is disconnected or connected to the tubular 62 at the wellhead 63. The pivoting means 113 has pivoted at pivot point 115 so as to extend below the stab frame 28. The sections of the pivoting means 113 extend below the stab frame 28 and toward the tubular 62 so as to place the guide member 112 in the extended position. The sections of the pivoting means 113 are designed to be a mechanical system that moves the guide member 112 downwardly and outwardly from the stab frame 28. The pivoting means 113 can also have a telescoping structure included therewith so that the pivoting means 113 pivots the guide member 112 downwardly and then telescopically extends the guide member 112 toward the tubular 62. The lateral stiffness of the guide member 112 assures proper alignment of the tubular 62. The first and second grippers 108 and 110 hold tubular 18 above tubular 62. The guide member 112 finely aligns the stab frame 28 in a position so that the first and second grippers 108 and 110 hold the tubular 18 exactly above the box 82 of tubular 62 for connection or disconnection. The pivoting means 113 is formed so that the guide member 112 is vertically aligned with the first and second grippers 108 and 110.

Figure 3:
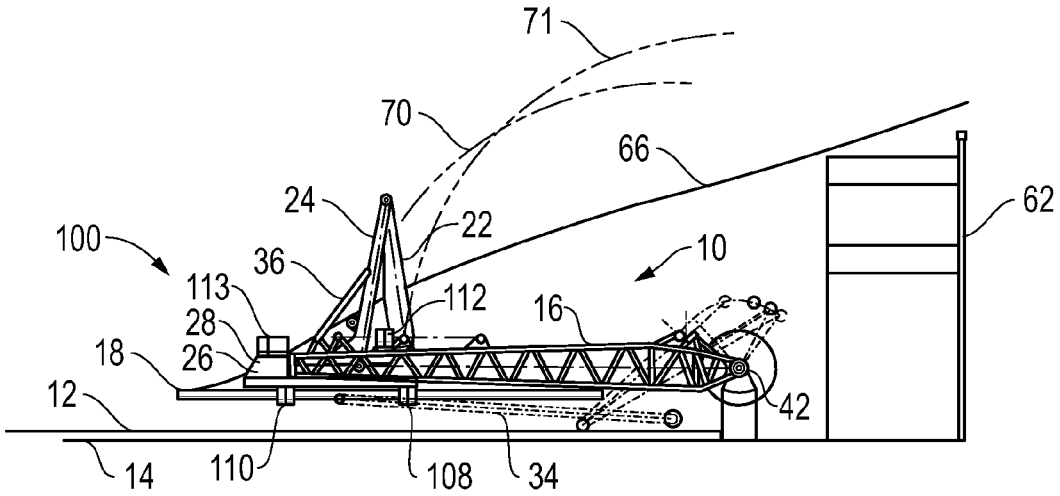
FIG. 3 shows a side elevational view of a tubular handling system in a first position, with the apparatus of the present invention attached thereto, and the guide member in the stowed position.

Referring to FIG. 3, there is shown a side elevational view of a tubular handling system 10 with the apparatus 100 of the present invention attached thereto. The tubular handling system 10 is in a first position. In the first position, the tubular 18 is in a horizontal orientation. The guide member 112 is in the stowed position relative to the stab frame 28. The first gripper 108 and the second gripper 110 hold the tubular 18 in the horizontal position. The tubular handling system 10 moves from the first position to a second position, which is shown in FIGS. 4 and 5.

Figure 4:
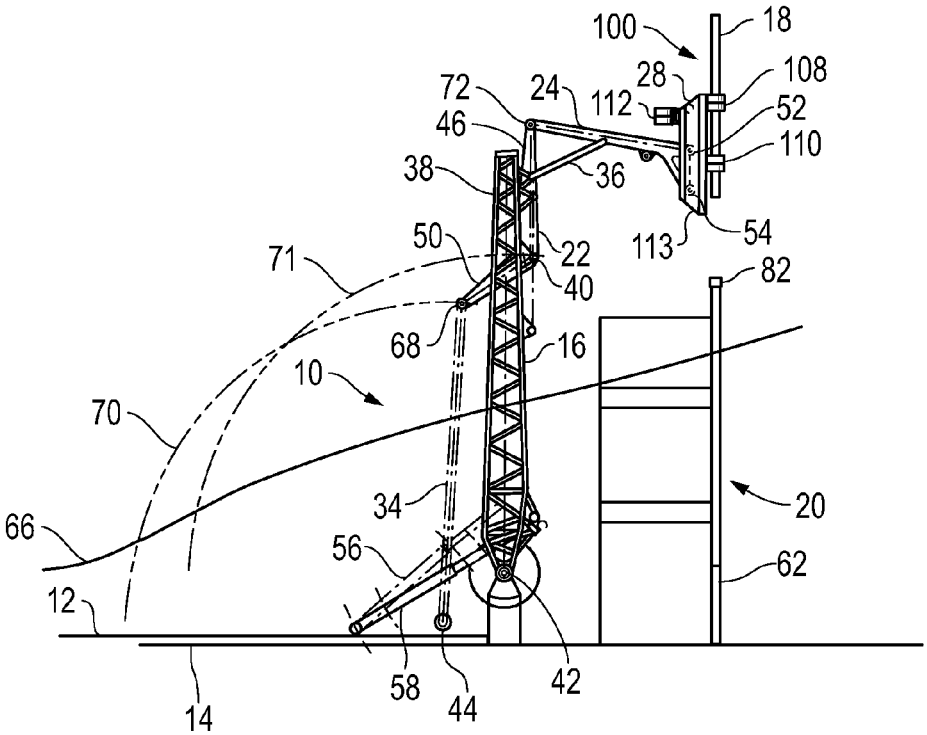
FIG. 4 shows a side elevational view of the tubular handling system in a second position, with the apparatus of the present invention attached thereto, and the guide member in the stowed position.
Figure 5:
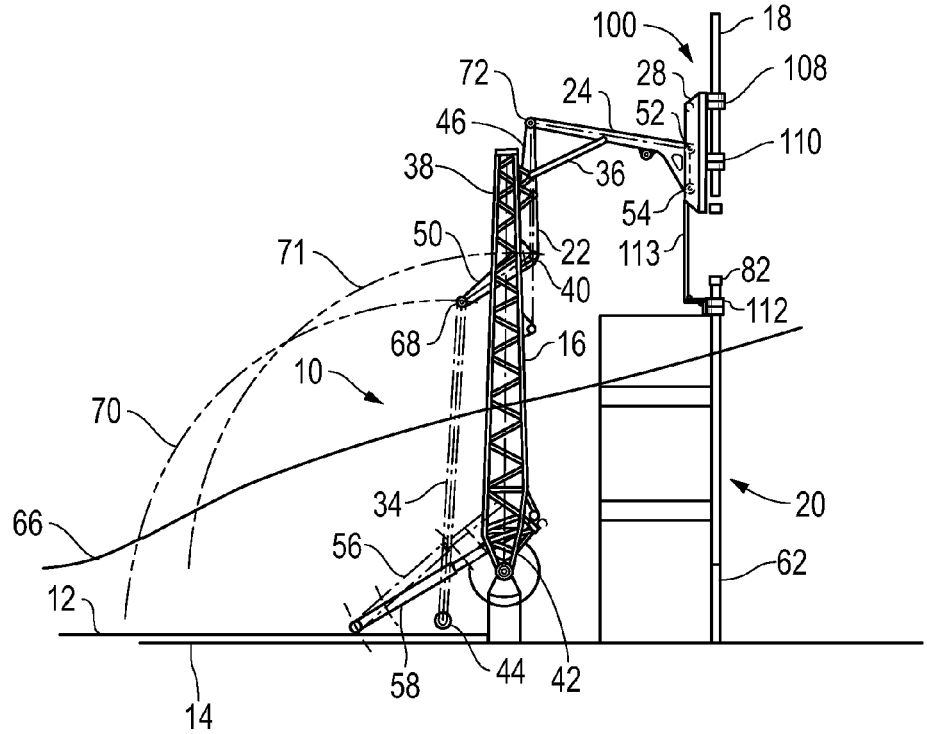
FIG. 5 shows a side elevational view of the tubular handling system in the second position, with the apparatus of the present invention attached thereto, and the guide member in the deployed position.

Referring to FIG. 4, there is shown a side elevational view of the tubular handling system 10 in the second position, with the guide member 112 of the apparatus 100 in the stored position. The tubular handling system 10 is mounted on a skid 12 that is supported upon the bed 14 of a vehicle, such as a truck. The tubular handling system 10 in particular includes a main rotating structural member 16 that is pivotally movable between a first position and a second position. In FIG. 4, an intermediate position of the tubular handling system 10 is particularly shown. In this position, the tubular 18 is illustrated in its position prior to installation on the drill rig 20. A lever assembly 22 is pivotally connected to the main rotating structural member 16. An arm 24 is pivotally connected to an end of the lever assembly 22 opposite the main rotating structural member 16. The stab frame 28 of the apparatus 100 is fixedly connected to an opposite end of the arm 24 opposite the lever assembly 22. The apparatus 100 has first gripper 108, guide member 112, and second gripper 110, as described above. A link 34 has one end pivotally connected to the skid 12 and an opposite end pivotally connected to the end of the lever assembly 22 opposite the arm 24. A brace 36 is pivotally connected to the main rotating structural member 16 and also pivotally connected to the arm 24 between the lever assembly 22 and the stab frame 28 of the apparatus 100.

In the tubular handling system 10, the main rotating structural member 16 is a structural framework of struts, cross members and beams. In particular, in the tubular handling system 10, the main rotating structural member 16 is configured so as to have an open interior such that the tubular 18 will be able to be lifted in a manner so as to pass through the interior of the main rotating structural member 16. As such, the end 38 of the main rotating structural member 16 should be strongly reinforced so as to provide the necessary structural integrity to the main rotating structural member 16. A lug 40 extends outwardly from one side of the main rotating structural member 16. This lug 40 is suitable for pivotable connection to the lever assembly 22. The main rotating structural member 16 is pivotally connected at the opposite end 42 to a location on the skid 12. The pivotable connection at end 42 of the main rotating structural member 16 is located in offset relationship and above the pivotable connection 44 of the link 34 with the skid 12. A small frame member 46 extends outwardly from the side of the main rotating structural member 16 opposite the link 34. This small frame member 46 has a pivotable connection with the brace 36.

The lever assembly 22 includes a first portion 48 and a second portion 50. The first portion 48 extends at an obtuse angle with respect to the second portion 50. The link 34 is pivotally connected to the end of the second portion 50 opposite the first portion 48. The arm 24 is pivotally connected to the end of the first portion 48 opposite the second portion 50. The lug 40 of the main rotating structural member 16 is pivotally connected in an area generally between the first portion 48 and the second portion 50. This unique arrangement of the lever assembly 22 facilitates the ability of the present invention to carry out the movement of the tubular 18 between the horizontal orientation and the vertical orientation.

The arm 24 has an end pivotally connected to the end of the first portion 48 of the lever assembly 22. The opposite end of the arm 24 is connected to the stab frame 28 of apparatus 100. In particular, a pair of pin connections engage a surface of the stab frame 28 of apparatus 100 so as to fixedly position the apparatus 100 with respect to the end of the arm 24. The pin connections 52 and 54 can be in the nature of bolts, or other fasteners, so as to strongly connect the stab frame 28 of the apparatus 100 with the arm 24. The bolts associated with pin connections 52 and 54 can be removed such that other stab frames of different sizes can be affixed to the end of the arm 24. As such, the tubular handling system 10 of the present invention can be adaptable to various sizes of tubular 18 and various heights of drilling rigs 20.

The stab frame 28 of the apparatus 100 has a first gripper 108, a second gripper 110 positioned below the first gripper 108, and a guide member 112. The first gripper 108 and the second gripper 110 have jaws similar to conventional grippers which can open and close so as to engage the outer surface of the tubulars 18 and 62. When the tubular handling system 10 is in the second position, the tubular 18 is somewhat properly aligned over tubular 62. However, actual use with the tubular handling system 10 found that a finer aligning mechanism was needed. Thus, the guide member 112 was added to the stab frame 28 so as to further properly align the stab frame 28, the first gripper 108, the second gripper 110, and thus the tubular 18, with the tubular 62. In FIG. 4, the guide member 112 is still in the stowed position.

The link 34 is an elongate member that extends from the pivotable connection 44 to the pivotable connection 68 of the second portion 50 of the lever assembly 22. The link 34 is non-extensible and extends generally adjacent to the opposite side from the main rotating structural member 16 from that of the arm 24. The link 34 will generally move relative to the movement of the main rotating structural member 16. The brace 36 is pivotally connected to the small frame member 46 associated with main rotating structural member 16 and also pivotally connected at a location along the arm 24 between the ends thereof. Brace 36 provides structural support to the arm 24 and also facilitates the desired movement of the arm 24 during the movement of the tubular 18 between the horizontal orientation and the vertical orientation.

Actuators 56 and 58 are illustrated as having one end connected to the skid 12 and an opposite end connected to the main rotating structural member 16 in a location above the end 42. When the actuators 56 and 58 are activated, they will pivot the main rotating structural member 16 upwardly from the horizontal orientation ultimately to a position beyond vertical so as to cause the tubular 18 to achieve a vertical orientation. Within the concept of the present invention, a single hydraulic actuator can be utilized instead of the pair of hydraulic actuators 56 and 58, as illustrated in FIG. 4.

In FIG. 4, the general movement of the bottom end of the tubular 18 is illustrated by line 66. The movement of the pivot point 68 of the connection between the lever assembly 22 and the link 34 is illustrated by line 70. Curved line 71 illustrates the movement of the pivotable connection 40 between the main rotating structural member 16 and the lever assembly 22.

Because the skid 12 is located on the bed of a vehicle 14, the vehicle 14 can be maneuvered into place so as to properly align with the centerline of the drill pipe 62 of the drilling rig 20. Once the proper alignment is achieved by the vehicle 14, the system 10 can be operated so as to effectively move the tubular 18 to its desired position. The apparatus 100 allows the drill tubular 18 to be moved upwardly and downwardly for the proper stabbing of the drill pipe 62. The present invention is adaptable to various links of tubular 18. Various types of stab frames 28 can be installed on the end of the arm 24 so as to properly accommodate longer lengths of tubular 18.

Instead of the complex control mechanisms that are required with prior art systems, results are achieved by simple maneuvering of the vehicle 14, along with operation of the hydraulic cylinders 56 and 58. All other linkages and movement of the tubular 18 are achieved purely because of the mechanical connections between the various components. As such, the present invention assures a precise, self-centering of the tubular 18 with respect to the desired connecting pipe 62.

Referring to FIG. 5, there is shown a side elevational view of the tubular handling system 10 in the second position, with the guide member 112 in the deployed position. The guide member 112 is moved relative to the stab frame 28 mounted on apparatus 100 by the pivoting action provided by the pivoting means 113. The guide member 112 firmly receives the tubular 62 at the wellhead so as to force the stab frame 28 into proper alignment with the tubular 62. The first and second grippers 108 and 110 position tubular 18 over the box 82 of tubular 62 at the wellhead 63. The deployed position of the guide member 112 insures that the stab frame 28 rigidly aligns grippers 108 and 110 over gripper 112. Various actions can be taken while the apparatus 100 holds tubulars 18 and 62 in alignment. For example, the tubulars 18 and 62 can be connected or disconnected.

Referring again to FIG. 3, the drill tubular 18 is in a generally horizontal orientation. It is important to note that the tubular 18 can be delivered to the tubular handling system 10 in a position below the main rotating structural member 16. In particular, the tubular 18 can be loaded upon the skid 12 in a location generally adjacent to the first gripper 108, the second gripper 110, and the guide member 112 associated with the stab frame 28. As such, the tubular handling system 10 facilitates the easy delivery of the tubular 18 to a desired location. The first gripper 108 and the second gripper 110 grip the outer surface of the tubular 18 in this horizontal orientation.

In FIG. 3, it can be seen that the main rotating structural member 16 resides above the tubular 18 and in generally parallel relationship to the top surface of the skid 12. The lever assembly 22 is suitably pivoted so that the arm 24 extends through the interior of the framework of the main rotating structural member 16 and such that the first gripper 108 and second gripper 110 on the stab frame 28 engage the tubular 18. The brace 36 resides in connection with the small framework of the main rotating structural member 16 and also is pivotally connected to the arm 24. The link 34 resides below the main rotating structural member 16 generally adjacent to the upper surface of the skid 12 and is connected to the lever assembly 22 below the main rotating structural member 16.

Figure 6:
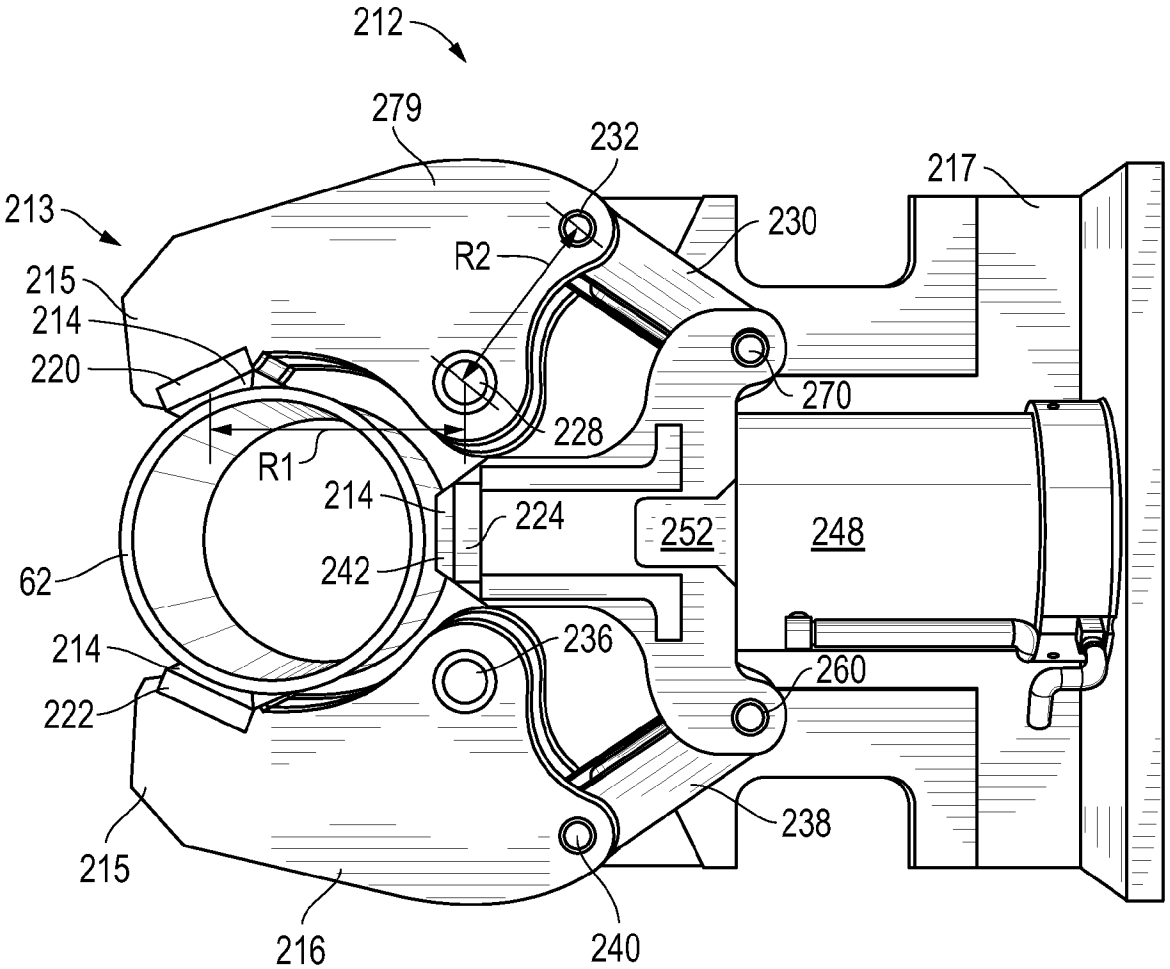
FIG. 6 shows a top perspective view of the guide member.

Referring to FIG. 6, there is shown a top perspective view of each of the grippers 108 and 110 of the disclosed invention, designated as 212. The gripper 212 has a jaw assembly 213 positioned around the outer surface of tubular 62. The jaw assembly 213 has tubular gripping surfaces 214 on the end 215 thereof. The tubular gripping surfaces 214 contact the tubular 62 when the gripper 212 is in the second position. The gripper 212 has a housing 217. The housing 217 covers the top, back, and bottom of the gripper 212. The jaw assembly 213 has a portion that moves within the housing 217. The unique configuration of the jaw assembly 213 allows the gripper 212 to grip large and small diameters of tubulars without having to change the jaws of the jaw assembly 213. Thus, the gripper 212 eliminates the need for additional adapters and thus removes the associated costs from gripping tubulars.

The jaw assembly 213 has a first jaw 279 and a second jaw 216. The first jaw 279 has a pipe-contacting surface 220 at one end 215 thereof. The second jaw 216 has a pipe-contacting surface 222 at one end 215 thereof. The first and second jaws 279 and 216 are connected to a drive yoke 252. A first link 230 is connected to the first jaw 279 and the drive yoke 252. The first link 230 is pivotally connected at a first pivot point 232 to the first jaw 279. The first link 230 is pivotally connected at a second pivot point 270 to the drive yoke 252. A second link 238 is connected to the second jaw 216 and to the drive yoke 252. The second link 238 is connected at a first pivot point 240 to the second jaw 216. The second link 238 is pivotally connected at a second pivot point 260 to the drive yoke 252. An elastomeric pad is the pipe-contacting surface 220 of the first jaw 279. As such, the pipe-contacting surface 220 is slightly flexible so as to avoid any damage to the outer surface of the tubular 62. An elastomeric pad is the pipe-contacting surface 222 of the second jaw 216. The links 230 and 238 ensure that there is a proper movement of the jaws 279 and 216 radially inwardly relative to the movement of the drive yoke 252. The links 230 and 238 are anchored to housing 217.

An actuator means 248 is interconnected to the first jaw 279, to the second jaw 216 and to the drive yoke 252 so as to move the tubular-contacting surfaces 220, 222 and 242 radially inwardly and simultaneously for an identical distance. The drive yoke 252 is generally an elongated longitudinal member extending toward the tubular 62. An elastomeric pad is located on the end 224 of the drive yoke 252 as the tubular-contacting surface 242. The present invention contemplates that the pipe-contacting surfaces 220, 222 and 242 can be an elastomeric pad of a gripper, a toothed die of a tong, or a roller of a spinner.

The first link 230 has a pivot point 232 at an end opposite pivot point 270. Likewise, the second link 238 has a pivot point 240 at an end opposite pivot point 260. As the drive yoke 252 moves toward the tubular 62, the links 230 and 238 cause the respective jaws 279 and 216 to rotate the pipe-contacting surfaces 220 and 222 inwardly toward the outer surface of tubular 62. If the diameter of tubular 62 is smaller, then the drive yoke 252 will move further toward the tubular 62 so as to cause the jaws 279 and 216 to rotate further inwardly. The movement of the drive yoke 252 causes the tubular-contacting surface 242 to contact the outer surface of tubular 62.

A novel aspect of the gripper 212 of the present invention is that a variety of tubular diameters can be utilized without the need to change the jaws 279 and 216 of the gripping apparatus 210. The present invention automatically grips different diameters of pipe while, at the same time, ensuring a centering of such pipes with minimal error. The jaws 279 and 216 have two important measurements, R1 and R2. R1 is the distance between jaw pivot points 228 and 236 and the pipe-contacting surfaces 220 and 222 of the first and second jaws 279 and 216, respectively. R2 is the distance between the first pivot points 232 and 240 of the first and second links 230 and 238, and the jaw pivot points 228 and 236 of the first and second jaws 279 and 216, respectively.

In the gripper 212, distance R1 is not equal to R2. Prior art is limited in that it requires R1 to equal R2. Having R1 not equal to R2 in the present invention allows the present invention to grip different diameters of tubulars while simultaneously centering with minimal error. Any number of customized variations of tubular diameter ranges can be accommodated by geometrically solving for the optimum size of links 230 and 238 and appropriately sizing the distances R1 and R2 of the jaws 279 and 216 so as to provide the best mechanical advantage for the space available. Sizing the gripper 212 of the present invention in this manner allows the gripper 212 to grip with zero centering error for any two tubular reference diameters and nearly zero error for any tubular diameter between the reference diameters and just less than the smaller reference diameter and just more than the larger reference diameter. The apparatus 100 of the present invention achieves zero centering error for any two tubular diameters. The present invention contemplates that any range of diameters would have a large diameter that is several times the value of the small diameter, and wherein this range of tubular diameters would have exactly zero centering error for at least two specific sizes of pipe. The present invention also is unlimited in the geometry relative to the distances R1 and R2. That is, R1 and R2 can be any values where R1 is not equal to R2.

Another important and novel feature of the present invention is the orientation of the links 230 and 238. First link 230 is pivotally connected to the drive yoke 252 at second pivot point 270. Link 230 angles outwardly to first pivot point 232, where the first link 230 is pivotally connected to the first jaw 279. Likewise, the second link 238 is pivotally connected to the drive yoke 252 at second pivot point 260 and angles outwardly to first pivot point 240, where the second link 238 is pivotally connected to the second jaw 216. The outward angle of links 230 and 238 uses less space than prior art gripping apparatuses that have links extending parallel to the length of the gripper. Thus, the gripper 212 of the present invention can be used in smaller spaces than prior art gripping apparatus. The links 230 and 238 move both laterally and longitudinally, as opposed to only longitudinally.

When it is desired to release the tubular 62, it is only necessary for the piston-and-cylinder assembly of actuator means 248 to move rearwardly. This serves to cause the tubular-contacting surfaces 220, 222 and 242 of the first jaw 279, second jaw 216, and drive yoke 252, respectively, to move radially outwardly away from the outer surface of the tubular 62 so as to properly release the tubular 62 in a desired location. Further movement of the piston-and-cylinder assembly of the actuator means 248 rearwardly of the gripper 212 will cause the jaws 279 and 216, along with the drive yoke 252, to move the tubular-contacting surfaces 220, 222 and 242 further away from each other so that this opening will allow the introduction of another tubular 62. Through the use of the present invention, a variety of tubular diameters can be utilized without the need to change the gripping gripper 212. The gripper 212 of the present invention automatically grips different diameters of tubular while, at the same time, assuring a proper centering of such tubulars. The size of the links 230 and 238, along with the relationship between the respective pivot points 232, 270, 240, and 260, is engineered so as to assure such simultaneous movement.

Figure 7:
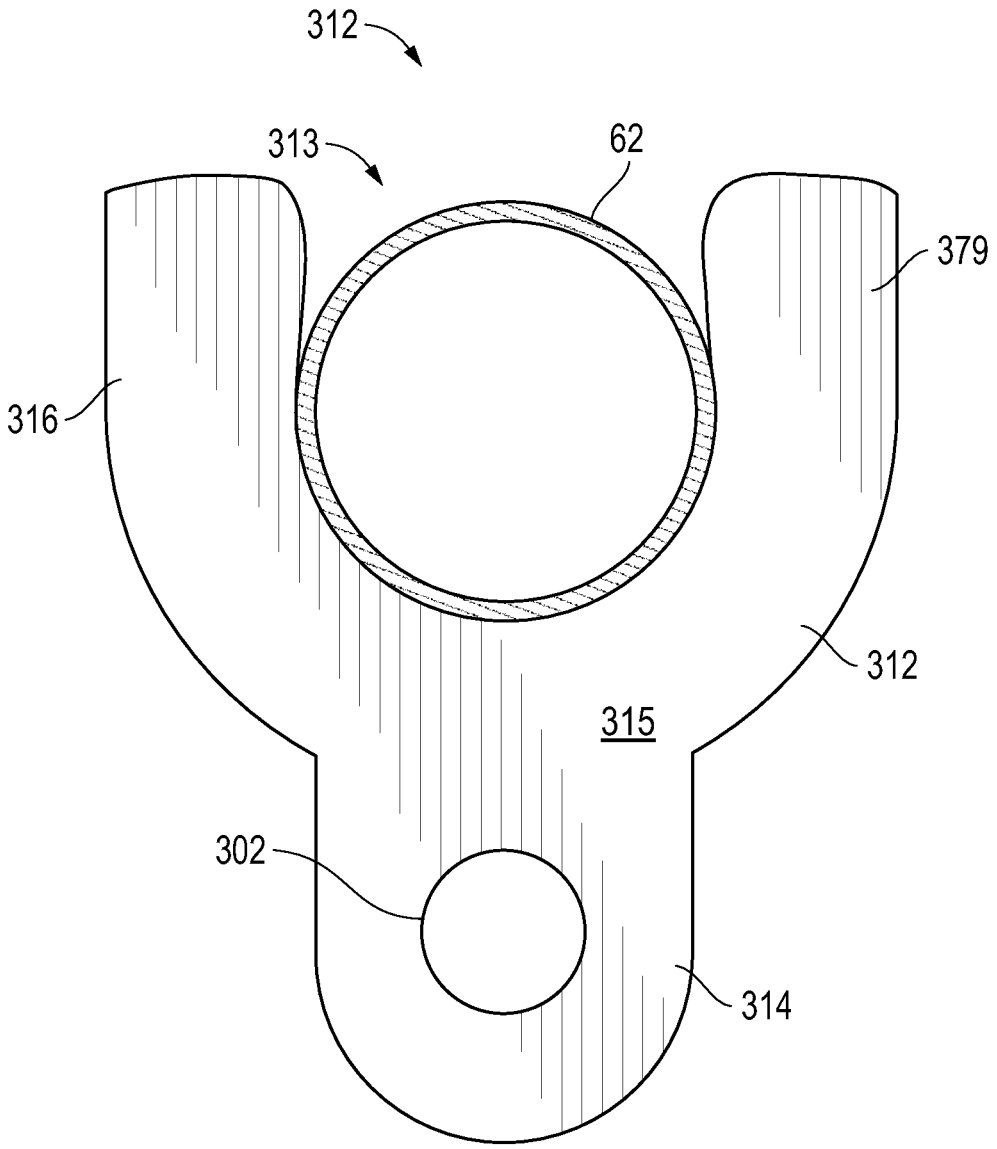
FIG. 7 shows a plan view of another embodiment of the guide member.

Referring to FIG. 7, there is shown a plan view of the guide member 112 designated as 312. The guide member 312 has a jaw assembly 313. The jaw assembly 313 has a first jaw 379 and a second jaw 316. The jaws 379 and 316 wrap around the outer surface of tubular 62. The jaws 379 and 316 are integrally formed and form a U-shape. The slot defined by this U-shape has sides that are spaced from each other by a distance approximately equal to a diameter of the tubular. This curved end of the U-shape has a radius approximately equal to a radius of the tubular. A support structure 314 extends from a curved portion 315 of the jaw assembly 313. The support structure 314 extends from a side of the jaw assembly 313 opposite the tubular 62. The support structure 314 connects to the pivoting means 113. The support structure 314 has a hole 302 formed therein. The pivoting means 113 attaches to the clamp 312 by connection that utilizes the support structure 314 in the hole 302 formed therein. There are no moving parts on the second alternative embodiment of the guide member 312. The jaws 379 and 316 fit around the tubular 62 and resist lateral movement of the apparatus 100 by pushing against the outer surface of the tubular 62.

The foregoing disclosure and description of the invention is illustrative and explanatory thereof. Various changes in the details of the described construction can be made without departing from the true spirit of the invention. The present invention should only be limited by the following claims and their legal equivalents.

We claim:

1. An apparatus for centering a first tubular with respect to a second tubular at a wellhead, the apparatus comprising:

a frame;

a gripping member extending outwardly of the frame, the gripping member suitable for gripping the first tubular; and a guide member pivotally connected to the frame and extending outwardly therefrom, the guide member positioned below the gripping member, the guide member pivoting between a stowed position on a first side of the frame farther from the wellhead and a deployed position on an opposite side of the frame closer to the wellhead, the center of the guide member being vertically aligned with the center of the gripping member when the gripping member is in the deployed position, the guide member having an open-ended slot sized and configured for receiving a portion of the second tubular.

2. The apparatus of claim 1, the guide member comprising:

a guide body having the slot formed therein; and an arm affixed at one end to the guide body and pivotally connected to the frame at an opposite end thereof.

3. The apparatus of claim 2, the frame having a front surface and a back surface, the arm being juxtaposed against the back surface when the guide member is in the stowed position.

4. The apparatus of claim 1, the guide member extending horizontally outwardly from the frame, the guide member extending horizontally directly below the gripping member.

5. The apparatus of claim 1, the gripping member comprising:

a first gripper; and a second gripper extending in parallel spaced relation to the first gripper.

6. The apparatus of claim 1, the gripping member comprising:

a jaw assembly having a tubular-contacting surface;

a drive yoke having a tubular-contacting surface, the drive yoke connected to the jaw assembly; and an actuator connected to the drive yoke, the actuator moving the jaw assembly and the drive yoke such that the tubular contacting surfaces move radially for a substantially identical distance.

7. The apparatus of claim 6, the jaw assembly comprising:

a first jaw connected to the drive yoke; and a second jaw connected to the drive yoke, the gripping member further comprising:

a first link connected to the first jaw and to the drive yoke, the first link being pivotally connected to the first jaw at a first pivot point, the first link being pivotally connected to the drive yoke at a second pivot point; and a second link connected to the second jaw and to the drive yoke, the second link being pivotally connected to the first jaw at a first pivot point, the second link being pivotally connected to the drive yoke at a second pivot point.

8. The apparatus of claim 1, the opposing sides of the slot of the guide member spaced from each other by a distance approximately equal to a diameter of the second tubular.

9. The apparatus of claim 8, the slot of the guide member having an inner surface extending between the first side and the second side, the inner surface having a radius approximately equal to a radius of the second tubular.

10. The apparatus of claim 1, further comprising:

a structural member that pivots from a generally horizontal orientation and an upwardly extending position; and an arm interconnected to the structural member and extending outwardly therefrom, the frame connected to an end of the arm.

11. The apparatus of claim 10, wherein the arm extends outwardly of the structural member when the structural member is in the upwardly extending position.

12. The apparatus of claim 1, the slot of the guide member being formed between two spaced apart opposing sides, and having a center vertically aligned with a center of the gripping member.

13. An apparatus for centering a first tubular with respect to a second tubular at a wellhead, the apparatus comprising:

a structural member;

an arm interconnected to the structural member;

a frame connected to an end of the arm;

a gripping member extending outwardly of the frame, the gripping member suitable for gripping the first tubular; and a guide member pivotally connected to the frame so as to be movable between a stowed position on a side of the frame farthest from the wellhead and a deployed position on an opposite side of the frame, nearest the wellhead, the guide member having an interior opening suitable for receiving and guiding a portion of the second tubular when the guide member is in the deployed position.

14. The apparatus of claim 13, the interior opening having a center that is vertically aligned with a center of the gripping member when the guide member is in the deployed position.

15. The apparatus of claim 13, the interior opening of the guide member having a first side and a second side spaced from each other by a distance approximately equal to a diameter of the second tubular.

16. The apparatus of claim 15, the interior opening of the guide member having an inner surface extending between the first side and the second side, the inner surface having a radius approximately equal to a radius of the portion of the second tubular.

17. The apparatus of claim 13, the guide member comprising:

a guide body having the interior opening formed therein; and an arm affixed at one end to the guide body and pivotally connected to the frame at an opposite end thereof.

18. The apparatus of claim 17, the frame having a front surface and a back surface, the arm being juxtaposed against the back surface when the guide member is in the stowed position.

19. The apparatus of claim 13, the structural member movable between a general horizontal orientation and an upwardly extending orientation, the arm extending outwardly of the structural member when the structural member is in the upwardly extending position.

20. The apparatus of claim 19, further comprising:

a skid pivotally connected to the structural member and extending in a horizontal orientation;

a lever assembly pivotally connected to the structural member, the lever assembly having a first portion extending outwardly at an obtuse angle with respect to a second portion;

a link pivotally connected to the second portion of the lever assembly; and a brace having an end pivotally connected to the structural member at an opposite end pivotally connected to the arm, the arm being pivotally connected at one end to the first portion of the lever assembly and extending outwardly therefrom.

* * * * *